US009834952B1

(12) United States Patent
Meyers et al.

(10) Patent No.: US 9,834,952 B1
(45) Date of Patent: Dec. 5, 2017

(54) AWNING ASSEMBLY

(71) Applicant: DOMETIC SWEDEN AB, Solna (SE)

(72) Inventors: Clayton Hendry Meyers, Middlebury, IN (US); Kyle Patrick Albertson, Maumee, OH (US)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 15/223,825

(22) Filed: Jul. 29, 2016

(51) Int. Cl.
*E04H 15/08* (2006.01)
*E04F 10/06* (2006.01)

(52) U.S. Cl.
CPC ..... *E04H 15/08* (2013.01); *E04F 10/0688* (2013.01)

(58) Field of Classification Search
CPC .. E04H 15/08; E04F 10/0688; E04F 10/0648; E04F 10/0655
USPC ..... 160/67
See application file for complete search history.

(56) References Cited

U.S. PATENT DOCUMENTS

| | | | |
|---|---|---|---|
| 3,327,724 | A | 6/1967 | Nielsen |
| 3,779,302 | A | 12/1973 | Akers et al. |
| 3,847,171 | A | 11/1974 | Akers et al. |
| 3,991,805 | A | 11/1976 | Clauss |
| 4,117,876 | A | 10/1978 | Bennett |
| 4,164,972 | A | 8/1979 | Bennett |
| 4,171,013 | A | 10/1979 | Clark |
| 4,180,117 | A | 12/1979 | Greer |
| 4,188,964 | A | 2/1980 | Greer |
| 4,347,886 | A | 9/1982 | von Knorring |
| 4,494,707 | A | 1/1985 | Niibori et al. |
| 4,524,791 | A | 6/1985 | Greer |
| 4,727,897 | A | 3/1988 | Watts |
| 4,862,940 | A | 9/1989 | Atchison |
| 4,941,524 | A | 7/1990 | Greer |
| 5,172,743 | A | 12/1992 | Wallace et al. |
| 5,351,736 | A | 10/1994 | Laffler et al. |
| 5,365,989 | A | 11/1994 | Eger et al. |
| 5,383,346 | A | 1/1995 | Laffler et al. |
| 5,427,168 | A | 6/1995 | Lohausen |
| 5,472,007 | A | 12/1995 | Malott |
| 5,549,129 | A | 8/1996 | Becker |
| 5,558,145 | A | 9/1996 | Baka |
| 5,560,411 | A | 10/1996 | Becker |
| 5,566,918 | A | 10/1996 | Becker |
| 5,622,214 | A | 4/1997 | Baka et al. |
| 5,636,675 | A | 6/1997 | Baka et al. |

(Continued)

FOREIGN PATENT DOCUMENTS

| | | |
|---|---|---|
| DE | 202013000297 | 12/2013 |
| GB | 2445289 | 7/2008 |

OTHER PUBLICATIONS

Transmittal Letter of Related Cases.

(Continued)

*Primary Examiner* — Blair M Johnson
(74) *Attorney, Agent, or Firm* — Middleton Reutlinger

(57) ABSTRACT

Various embodiments of an awning assembly, specifically an angled gear motor are provided. Present embodiments provide a motor for an awning assembly, wherein the motor is positioned in the awning hardware. Specifically, the motor may be supported by the awning hardware. The awning assembly may also have an angled transmission connected to the motor. The transmission and motor provide rotating movement of the awning roller tube.

30 Claims, 9 Drawing Sheets

(56) References Cited

U.S. PATENT DOCUMENTS

| | | | | |
|---|---|---|---|---|
| 5,669,430 | A | 9/1997 | Malott | |
| 5,732,756 | A | 3/1998 | Malott | |
| 5,924,465 | A | 7/1999 | Malott | |
| 5,944,085 | A | 8/1999 | Malott | |
| 6,000,501 | A | 12/1999 | Evans | |
| 6,006,810 | A | 12/1999 | Malott | |
| 6,021,834 | A | 2/2000 | Malott | |
| 6,021,835 | A | 2/2000 | Malott | |
| 6,029,732 | A | 2/2000 | Malott | |
| 6,089,306 | A | 7/2000 | Frey, Jr. | |
| 6,112,392 | A | 9/2000 | Becker et al. | |
| 6,206,078 | B1 | 3/2001 | Frey, Jr. | |
| 6,276,424 | B1 | 8/2001 | Frey, Jr. | |
| 6,279,641 | B1 | 8/2001 | Malott | |
| 6,341,638 | B1 * | 1/2002 | Thompson | E04F 10/0614 160/67 |
| 6,361,570 | B1 | 3/2002 | Gow | |
| 6,488,069 | B1 | 12/2002 | Mashaw et al. | |
| 6,497,267 | B1 | 12/2002 | Azar et al. | |
| 6,829,861 | B1 | 12/2004 | Kobrehel et al. | |
| 6,840,568 | B2 | 1/2005 | Carrillo et al. | |
| 6,843,301 | B2 | 1/2005 | Carrillo et al. | |
| 6,874,559 | B1 | 4/2005 | Hicks | |
| 6,971,433 | B2 | 12/2005 | Wagner et al. | |
| 7,077,458 | B2 | 7/2006 | Malott et al. | |
| 7,121,314 | B2 | 10/2006 | Hicks et al. | |
| 7,281,560 | B2 | 10/2007 | Hicks et al. | |
| 7,556,079 | B2 | 7/2009 | Hicks et al. | |
| 7,628,194 | B2 | 12/2009 | Wagner et al. | |
| 7,828,036 | B2 | 11/2010 | Tran | |
| 7,967,050 | B2 | 6/2011 | Gutierrez | |
| 8,006,737 | B2 | 8/2011 | Popa | |
| 8,205,656 | B2 | 6/2012 | Ma | |
| 8,316,910 | B2 | 11/2012 | Popa et al. | |
| 8,336,256 | B2 | 12/2012 | Jeffrey et al. | |
| 8,752,565 | B2 | 6/2014 | Mcconnell et al. | |
| 8,752,606 | B2 | 6/2014 | Albrecht et al. | |
| 8,887,785 | B2 | 11/2014 | Goth | |
| 8,960,256 | B2 | 2/2015 | Wagner et al. | |
| 9,175,481 | B2 * | 11/2015 | Albrecht | E04F 10/0614 |
| 9,228,359 | B2 | 1/2016 | Taylor | |
| 2004/0221965 | A1 * | 11/2004 | Wagner | E04F 10/0625 160/67 |
| 2005/0072532 | A1 | 4/2005 | Holden et al. | |
| 2013/0098562 | A1 | 4/2013 | Gutierrez | |
| 2014/0352893 | A1 * | 12/2014 | Malott | E04F 10/0625 160/67 |
| 2017/0138056 | A1 | 5/2017 | Albertson | |

OTHER PUBLICATIONS

Australian Patent Application No. 2016222517 entitled "Awning Assembly" filed Sep. 5, 2016.

Canadian Patent Application No. 2,942,465 entitled "Awning Assembly" filed Sep. 5, 2016.

Canadian Patent Application No. 2,948,063 entitled "Awning Assembly Attachment" filed Nov. 10, 2016.

Carefree of Colorado; Buena Vista, 16 pages, https://www.e-carefree.com/documentation/tech/052578-001r2%20Buena%20Vista.pdf Mar. 1, 2013.

Dometic Products, 2014 Full Line Catalog; Dometic Awnings; Patty O'Room Jan. 1, 2014.

U.S. Appl. No. 15/581,025 entitled "Awning Assembly and Method Thereof" filed Apr. 28, 2017.

* cited by examiner

AWNING ASSEMBLY

CROSS REFERENCE TO RELATED APPLICATION

None.

BACKGROUND

1. Field of the Invention

Present embodiments relate to a retractable awning assembly. More specifically, present embodiments relate to, without limitation, a retractable awning assembly which utilizes a gear motor structure wherein the motor is positioned in and supported by the awning arm.

2. Description of the Related Art

Retractable awnings are utilized to create a shaded space and create additional usable area outside a recreational vehicle (RV), building, marine vehicle or other mobile or fixed structure such as a building or other commercial or residential structure. By creating a shaded area, users may add to the usable square footage of the RV or building wherein they would otherwise not be able to do so.

Various prior art roller awnings utilize a torsion spring assembly in order to assist in the retraction of the awning. However, the torsion spring and related assembly adds weight to the structure. It is a common desire, especially in the RV industry, to reduce the weight of products in order to improve the fuel efficiency of the vehicle and/or reduce the weight in order to decrease the complexity of the mounting accessories needed for the awning.

It is also desirable to reduce the bulk or size of the end covers of the awning arm. These structures may limit the distance between the awning assembly and a sidewall of an RV or building structure.

It would be desirable to provide an awning assembly which reduces the weight of the awning assembly and eliminates the need for a torsion spring. Further, it would also be desirable to provide a structure which reduces mounting complexity of the awning motor. Still further, it would be desirable to provide an assembly which reduces or eliminates the need for back-driving brake.

The information included in this Background section of the specification, including any references cited herein and any description or discussion thereof, is included for technical reference purposes only and is not to be regarded subject matter by which the scope of the invention is to be bound.

SUMMARY

Present embodiments are related to an awning assembly having an angled gear motor. The angled gear motor including a drive assembly which may include a motor and a drive, which may be an angled gear type transmission in some embodiments. The motor is disposed within and fully supported by the awning arm. This in turn reduces the size required for the end cap structure at the end of the awning arm. A transmission connected to the motor has an output or drive shaft which drives rotation of an awning roller tube. By using this assembly, the need for a torsion spring to aid with the retraction of the awning is eliminated and thus, provides a weight saving feature for the awning assembly. Further, the transmission eliminates the need for an additional back-brake.

According to some embodiments, an awning assembly comprises a first awning hardware having a first plurality of arms, a second awning hardware having a second plurality of arms, a canopy configured to extend or retract from a roller tube having a first lateral edge, a second lateral edge, an inner edge and an outer edge. A motor may be disposed within one of the arms. An angled transmission may be operably connected to the motor, the angled transmission disposed at an end of the one of the arms, the motor and the angled transmission may be configured to rotatably extend or retract the canopy.

Optionally, the angled transmission may comprise a worm, a worm gear and a plurality of gears. The worm may be disposed in a worm housing and the worm gear may be disposed in a gear housing. The worm may extend from the motor. The drive shaft may extend from the angled transmission. The roller tube may be operably connected to the drive shaft. The roller tube may further comprise an end cap engaging the drive shaft. The awning assembly may further comprise a joint connected to the drive shaft. The awning assembly may further comprise an arm tab disposed at an end of the one of the arms and a flange tab engaging the arm tab. The awning assembly further comprising a cover extending over the angled transmission at the end of the one of the arms. The motor and the angled transmission may be connected or may be being integrally manufactured. The roller tube may be configured to rotate adjacent to a sidewall. Alternatively, the roller tube may be configured to move toward and away from a sidewall.

According to some embodiments, an awning assembly comprises a canopy having a first lateral edge, a second lateral edge, an inner edge and an outer edge. A first hardware and a second hardware may each comprise at least one arm which may be configured to extend and retract with the canopy. A motor may be disposed at least partially within and supported by at least one of the arms, an angled gear transmission may be disposed at an end of the at least one of the arms, and the angled gear transmission may be driven by the motor and extend and retracting the canopy.

Optionally, the angled gear transmission may comprise a worm, a worm gear and a gear box. The awning assembly may further comprise a manual override on one of the worm gear and the gear box. The angled gear transmission may be disposed at an end of one of the hardware. The angled gear transmission may comprise a drive shaft extending from the gear box. One of the worm gear or a motor shaft may extend from the at least one of the arms. The awning assembly may further comprise a cover disposed over the angled gear transmission, the cover located at an end of the at least one arm. The motor and the angled gear transmission may be formed together or may be formed separately and joined during manufacture. The awning assembly may be a cassette awning or may be a moving roller tube-type awning.

According to some embodiments, an awning assembly comprises a first awning hardware having a first plurality of arms and a second awning hardware having a second plurality of arms. A canopy may have an inner edge and an outer edge extending between the first hardware and the second hardware and a first lateral edge and a second lateral edge. A motor may be supported by one of the arms and connected to the one of the arms by a motor flange. The motor may be one of partially in the arm, fully in the arm or spaced from and aligned with the arm. An angled transmission may be operably connected to the motor, the angled transmission disposed at an end of the one of the arms, the motor and the angled transmission configured to rotatably extend or retract the canopy. The awning assembly may further comprise a roller tube operably connected to the motor and the angled transmission. The roller tube may be configured to move with the first and second hardware during extension or retraction of the canopy. Alternatively, the roller tube is operated at a sidewall. The motor flange and the one of the arms may include tabs for locating the motor. The awning assembly may further comprise a joint between the transmission and the roller tube.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of an awning assembly will now be described by way of examples. These embodiments are not to limit the scope of the claims as other embodiments of the awning assembly will become apparent to one having ordinary skill in the art upon reading the instant description. Non-limiting examples of the present embodiments are shown in figures wherein:

DETAILED DESCRIPTION

Figure 1:
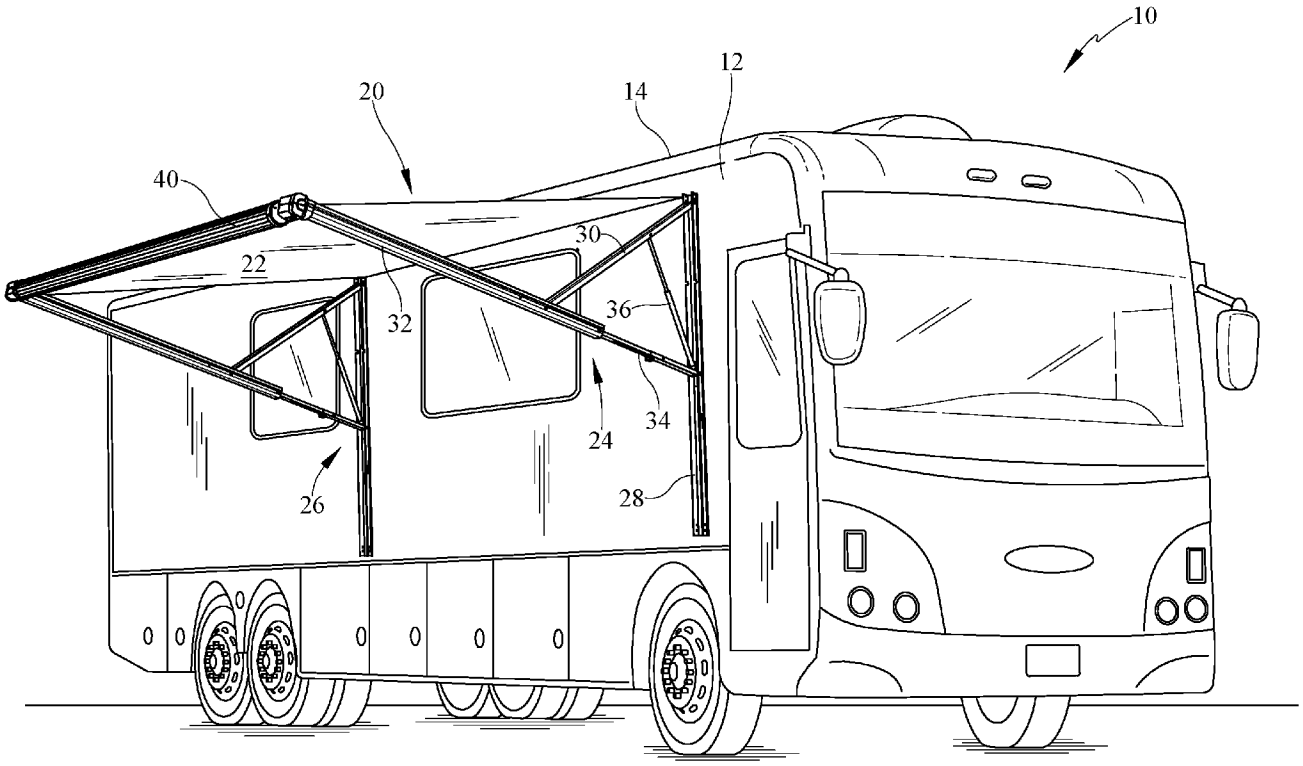
FIG. 1 is a perspective view of an awning assembly in an extended position.

It is to be understood that an awning assembly is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-9 various embodiments of an awning assembly. Present embodiments provide a motor for an awning assembly, wherein the motor is positioned in the awning hardware. Specifically, the motor may be supported by the awning hardware. The awning assembly may also have an angled transmission connected to the motor. The transmission and motor provide rotating movement of the awning roller tube.

Referring now to FIG. 1, a perspective view of a recreational vehicle (RV) 10 is depicted. The exemplary RV includes a drive and a transmission, not shown, as well as at least one sidewall 12 and a roof 14. It should be understood that although an RV 10 is referred to in the exemplary embodiments, one skilled in the art should understand that the use of the embodiments described herein is not limited to these drivable vehicles. The term "RV" is also meant to include towable structures, sometimes called campers, homes and other stationary structures as well as boats or other marine applications, for example which use canopy structures which may or may not be retractable, commercial vehicles, agricultural vehicles, horse trailers, and temporary structures such as those used at sports events, (tailgating), flea markets. Further, the embodiments may also be used with fixed structures having such shade canopies and therefore, the term RV is not limited to mobile structures but may also include fixed structures. All of these structures are considered to be usable with the awning assembly attachment of the present embodiments.

An awning assembly 20 is connected to the sidewall 12 and/or the roof 14 of the vehicle 10. In other embodiments, the awning assembly 20 may be retractable within the sidewall 12 so as to reduce the airflow interference of the awning assembly 20 while the vehicle 10 is being operated. The awning assembly 20 may be defined by various structures such as roller type awning, cassette awning or other types.

Figure 2:
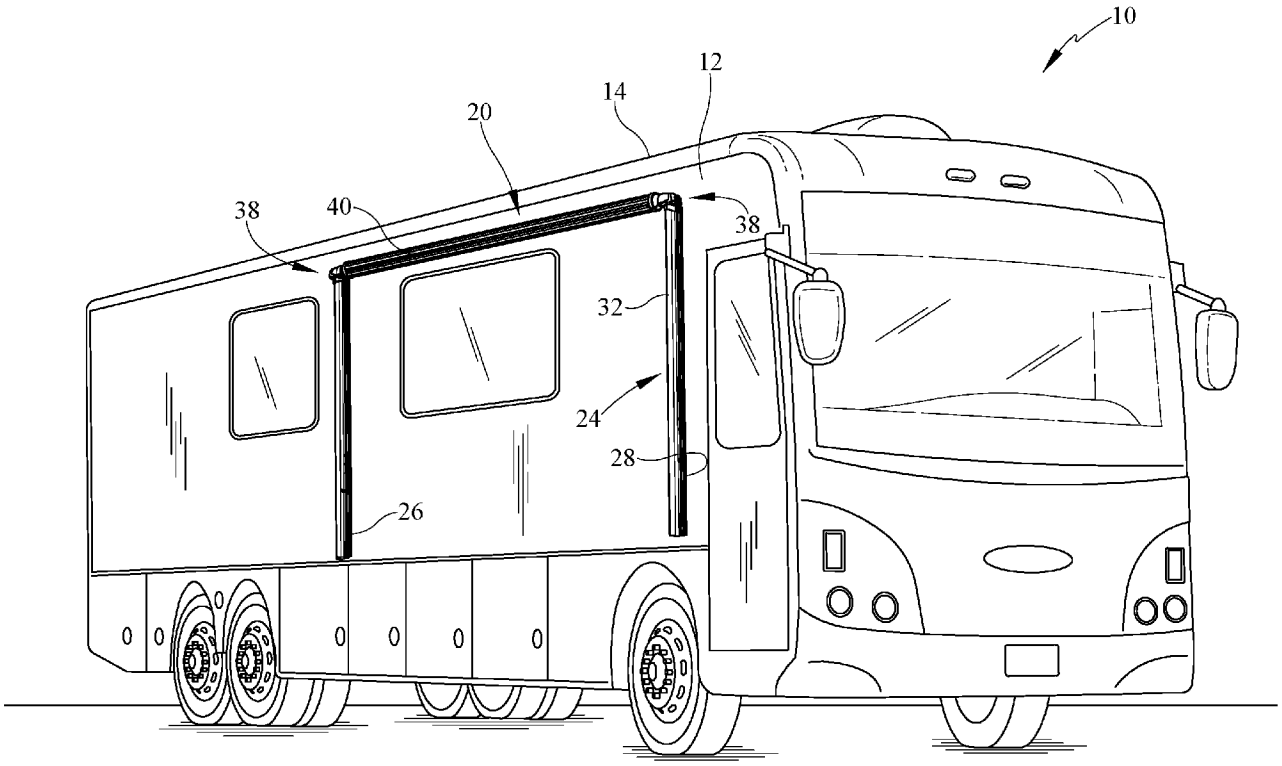
FIG. 2 is a perspective view of an awning assembly in a retracted position.

The awning assembly 20 includes an awning or canopy 22 and hardware assemblies 24, 26 defined by at least one first arm 28 and at least one second arm 30. The awning hardware assembly 24 is utilized, according to the instant embodiment, to connect the awning assembly 20 to the sidewall 12 of, for non-limiting example, the vehicle 10 or other fixed of mobile structure. The hardware assembly 24 allows for support of the canopy 22 in an extended position (shown) or in a retracted position (FIG. 2). The hardware assemblies or hardware 24, 26 support a movable awning bar 40. The awning bar 40 may be embodied by a roller tube in some embodiments which rotates to either extend or retract the awning canopy 22 or a non-rotating bar of circular or non-circular cross-section. In the non-rotating embodiment, the roller tube may be fixed in position at the sidewall to extend and retract the canopy, and accordingly, the non-rotating bar is located near the leading edge of the canopy which extends and retracts as discussed in further embodiments. Optionally, the hardware assembly 24 may also provide a pathway for wiring from a power source to the awning bar 40 to drive a motor or alternatively, for example may be routed through a hem in the canopy 22. Other wiring pathways may also be used however.

The canopy 22 includes an inner edge closer to the sidewall of an RV or fixed structure sidewall. The canopy 22 also includes an outer edge or leading edge further from the RV or fixed structure sidewall. Extending between the inner and outer edges are first and second lateral edges.

The awning bar 40 may be circular in cross-sectional shape in some embodiments. The awning bar 40, depicted as a roller tube, may include a first end and a second end with end caps. The awning bar 40 may be rotatably supported at or near ends to allow rotation for extension and retraction of the awning canopy 22. However, as will be described further, the present embodiments need not be limited to roller tube embodiments, as other types of awnings may be utilized.

Referring still to FIG. 1, the awning assembly 20 includes the awning canopy 22 and the first and second hardware assemblies 24 and 26. In this embodiment, each of the hardware assemblies are generally formed the same and therefore only hardware assembly 24 will be described. However, these hardware assemblies 24, 26 may be different and may also be embodied in differing forms from that which is depicted. The hardware assembly 24 supports the canopy 22 in the extended position (shown) and collapses to a compact, nested stack arrangement when the awning assembly 20 is retracted for road travel or when weather conditions preclude extended use of the awning assembly 20. In the retracted position, the hardware assemblies 24, 26 are generally positioned in a vertical arrangement near lateral edges of the canopy 22 and along sidewall 12 of the RV 10. In the extended position depicted, portions of the hardware assemblies 24, 26 extend outwardly from the RV sidewall 12.

The hardware assembly 24 may include a plurality of arms 28, 30, 32, 34 defining a four bar linkage comprising a first base arm 28, a second top arm 30, a third extending arm 32 and a fourth adjustable arm 34 which may allow for pitch adjustment. The hardware assemblies 24, 26 may comprise of one or more supports including a first arm 28 which is mounted to the sidewall 12 (FIG. 1). The second arm 30 is pivotally connected to and extends from the first arm 28. In the exemplary embodiment, the second arm 30 may extend from the upper end, however this is not limiting and merely one example of a configuration which may be utilized. The second arm 30 may be further sized so as to be nested in a nested arrangement with either or both of the first arm 28 and a third arm 32 which may be pivotally connected to an opposite end of the second arm 30 and spaced from the first arm 28. One or more struts 36 may be utilized to control movement of the second and third arms 30, 32. Additionally, an adjustable arm 34 may be utilized to position and adjust the extended configuration of the awning hardware assemblies 24, 26.

The weight of the awning assembly 20 in an extended position may cause one or more members of the hardware, for example strut 36 or arm 34, to vary in size, and result in the awning sagging. Further, this variation may be used to adjust the pitch of the awning canopy 22.

The first base arm 28 is connected to the RV sidewall 12 and may be channel-shaped having an open top which is capable of receiving a nested storage of the additional arms described in the following description of the hardware assembly 24. The first base arm 28 may be of a length so as to receive the additional arms in a compact nested arrangement so that those additional linkage arms do not extend from the bottom end of the first base arm 28. The channel shape is generally u-shaped and may have squared corners or rounded corners. Other shapes however may be utilized.

The first base arm 28 may be straight and elongated and may be formed in various manners, including but not limited to an extrusion process. The first base arm 28 may be formed of a high-strength, lightweight material such as aluminum or aluminum alloy, among other materials such as for non-limiting example roll formed steel which may be stronger. The channel shape comprises a main wall, a first side wall, and a second side wall defining the channel. The channel opening is outwardly facing so that the channel may receive the additional assembly arms when the awning assembly 20 is retracted.

Figure 3:
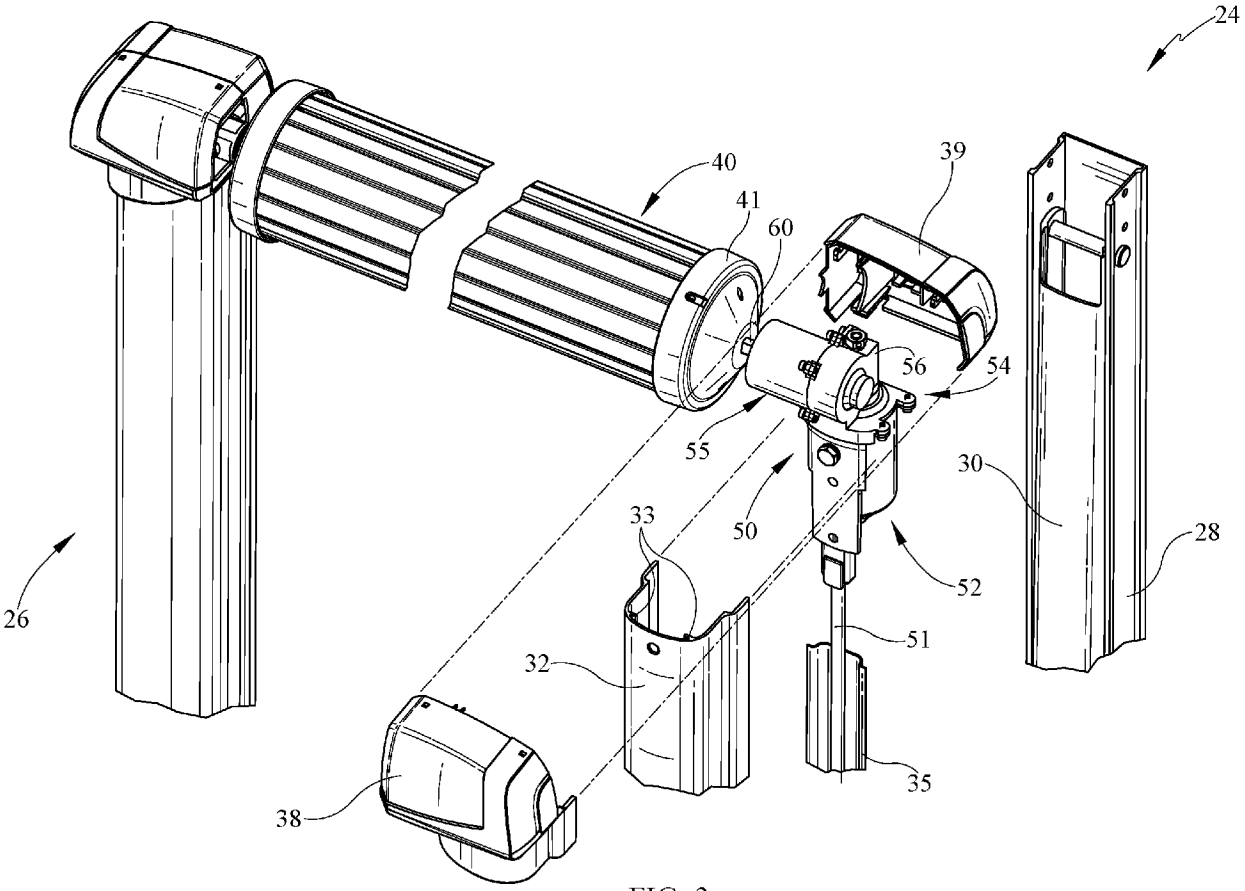
FIG. 3 is an exploded perspective view of an awning assembly.

With the awning hardware 24, 26 is shown in the example depicted, the awning arm 28 is represented and is generally channel shaped. The channel shape may be used for various reason including, but not limited to, the nesting of the one or more hardware arms. The awning arm 28 may also include a wire cover 35 (FIG. 3) providing a route wherein the wiring 51, including conductors for the awning motor 52 (FIG. 3). The wire cover 35 may be formed integrally or may be removable from the first arm 28. As the wiring 51 for the motor 52 (FIG. 3) may be routed within the first arm 28, and since it is desirable to inhibit damage to such wiring, the wiring 51 may be run beneath the wire cover 35 without damaging of the due to the movement of the other arms in this area. Further, while the wiring 51 is shown generally centered in the awning arm 28, it may be alternatively moved to a different location and further may or may not be retained by wire guides or other retaining structures, to set position or otherwise limit movement in the arm 28. Thus the second arm 30 and third arm 32 may be nested in the first arm 28, or within each other, and the wiring be clear of those moving components of the awning assembly 20. Other methods of routing the wiring may be utilized including cable ties or other features to retain the wiring in such a way that it is not inhibiting movement of other components of the awning assembly while also providing power to the awning motor 52 (FIG. 3).

Referring still to FIG. 1, the second arm 30 is pivotally connected to the first base arm 28 and extends at a second end to a third extended arm 32. The top arm 30 may also be formed of a high-strength, lightweight material such as aluminum alloy or steel and may be formed in various fashions including, but not limited to, an extrusion process. The wiring may follow this routing through the second arm 30 and through the third arm 32.

Extending outwardly from the first base arm 28 is the adjustable arm 34 which may allow adjustment of awning pitch, and the third extended arm 32. The third arm 32 and/or the adjustable arm 34 may also be formed in various shapes including, but not limited to, a generally channel shape.

The adjustable arm 34 extends from the base arm 28 and provides the capability to raise or lower corners of the awning assembly 20 disposed away from the RV sidewall 12. This adjustment of the corners allows independent raising or lowering of either end of the awning arm 30. Each adjustable arm 34 includes a first member and a second member which slide relative to one another to adjust total length. Therefore, each adjustable arm 34 may be adjusted to move and may be adjusted between an extended position and a collapsed position. Although the depicted embodiment provides for manual adjustment, it is contemplated that other mechanisms may be provided to provide automated adjustment. A lock or clamp may be provided to limit relative motion between the members when the adjustable arm 34 is set at a desired configuration. The locked or secure position may be engaged, for example when extended, collapsed, or any position there between. Additionally, the unlocked position allows for manual adjustment to a desired configuration, at which time the lock may be engaged. The lock may be embodied by a lock knob, clamp, fastener-nut, latch, other movement limiting structure or combinations thereof. While an adjustment arm 34 is described, which is shown to have pitch adjustment capability for the awning bar 40, one of ordinary skill in the art may recognize that various other adjustable functions may be provided by adjustable arm 34. Therefore, the adjustment arm 34 should not be considered solely limited to pitch adjustment. Still further, arm 34 may alternatively be defined in a rigid construction.

In some embodiments, the first and second members of the arm 34 may be foldable. In other embodiments, the members may be slidable in an axial direction of the members relative to one another. Similarly, the members may be retracted to vary the pitch of the awning assembly 20 and the canopy 22. This functionality may also be provided at the opposite hardware assembly 26 so that the pitch of the canopy 22 may be changed to allow for drainage, for example, or allow of uneven deployment or retraction of the awning assembly 20. Once a desired position is achieved, in the extended configuration, the adjustable arm 34 may be locked in various manners, for example a knob-lock assembly or other fastening structure.

The hardware assembly 24 may further comprise a biasing element such as the strut 36 which extends between the first base arm 28 and a second top arm 30. The strut 36 supports the second top arm 30 when the awning assembly 20 is in an extended or deployed position. The strut 36 further provides damping force for example, in windy conditions or during heavy rains. The strut 36 may be a gas strut, fluid strut or other suitable structure, such as a biasing element, spring, elastic element or other force applying and/or damping structure wherein the inner end of such structure is connected to the base arm 28 and the outer end connects to the second top arm 30. The strut 36 may be provided with pivoting joints, such as pivotable ball end joints, or other connectors so that the strut 36 pivots and may be received within the base arm 28 when the awning assembly 20 is retracted. The joints or ends of the strut 36 may connect to a mounting bracket or other similar structure which is connected to the base arm 28 by various types of fasteners including, but not limited to, rivets or screws.

The strut 36 applies a force on the awning assembly 20 to provide an opposed force to any force which may be applied by water collecting on the canopy 22 or alternatively, wind blowing against the canopy 22. For example, the strut 36 may also allow a corner of the awning assembly 20 to lower if the adjustable arm 34 is unlocked or unsecured. Alternatively, when the loading of the water or wind is gone, the strut 36 allows the awning assembly 20 to return the lowered corner into the desired position.

Referring now to FIG. 2, a perspective view of the awning assembly 20 in a retracted position. Shown used with the non-limiting embodiment of an RV, the awning assembly 20 is retracted against the sidewall 12. Further shown in the depicted embodiment, the hardware assemblies 24, 26 is in a nested arrangement wherein the various arms are folded and or slidable positioned against and/or within one or more of the arms.

Also, shown is the roller tube embodiment of the awning bar 40. The roller tube 40 is positioned between the hardware assemblies 24, 26. The ends of the hardware assemblies 24, 26 each include at least one cover wherein ends of the awning bar 40 are located. The at least one cover 38. As opposed to prior art covers, the instant at least one cover 38 is generally smaller in size which is advantageous for multiple reasons. First, the smaller size reduces weight which is desirable. Second, the smaller size provides less interference with the sidewall 12 of the RV or other structure.

In order to provide the at least one cover 38 in a smaller size, the motor is moved to within the hardware assembly 24. As a result, the at least one cover 38 need only hide the transmission rather than the transmission and the motor as in prior art devices.

Referring now to FIG. 3, an exploded perspective view of the hardware and an angled gear motor is depicted. The hardware assembly 24 is shown wherein one of the arms defining the hardware assembly 24 is exploded. The hardware assembly 24 comprises a base arm 28 which is connected to a sidewall as shown in FIGS. 1 and 2. The hardware assembly 24 also comprises the second arm 30 which is pivotally connected to the base arm 28 and the third arm 32 (exploded) which is connected to the second arm 30 in both a sliding and pivotal connection at a lower position not shown. The third arm 32 is shown exploded from the hardware 24 from a retracted position. The third arm 32 may be channel-shaped or otherwise have a hollow or partially hollow interior wherein an angled gear motor 50 may be positioned. The hardware assembly 24 also comprises the at least one cover 38. In the depicted embodiment, there are two cover structures 38, 39 which surround the angled gear motor 50 and specifically a transmission 54. The cover 38 may also cap the end of the hardware assembly 24 wherein the angled gear motor 50 is positioned in the third arm 32.

Also shown within the third arm 32 are arm tabs 33. A motor 52 may comprise flange tabs 69 (FIG. 4) which are located by the arm tabs 33 and also aid to return the motor 52 in the desired position relative to the arm 32, or hardware assembly 24 more generally. The tabs 33, 69 in combination provide a function of locating the gear motor 50 as well as supporting/transferring load from the gear motor to the hardware assembly 24.

The roller tube 40 is also depicted in the embodiment. An end cap 41 is shown connected to the roller tube 40 and operably engaging the angled gear motor 50. During operation, the angled gear motor 50 may be driven electrically to cause the roller tube 40 to rotate for either extension or retraction as shown in FIGS. 1 and 2.

A cable 51 is shown extending from the motor 52 and when the motor 52 is positioned in the hardware assembly 24, the cable 51 extends through the arm 32. The cable 51 may comprise one or more conductors for powering and controlling the motor operation. The cable 51 having this architecture may be routed through the hardware 24 to protect the cable 51 from fraying or the like. Further, the wire cover 35 may also be provided to guide the cable 51 within the arm 32 and protect the cable 51 during movement of arm 32.

Figure 4:
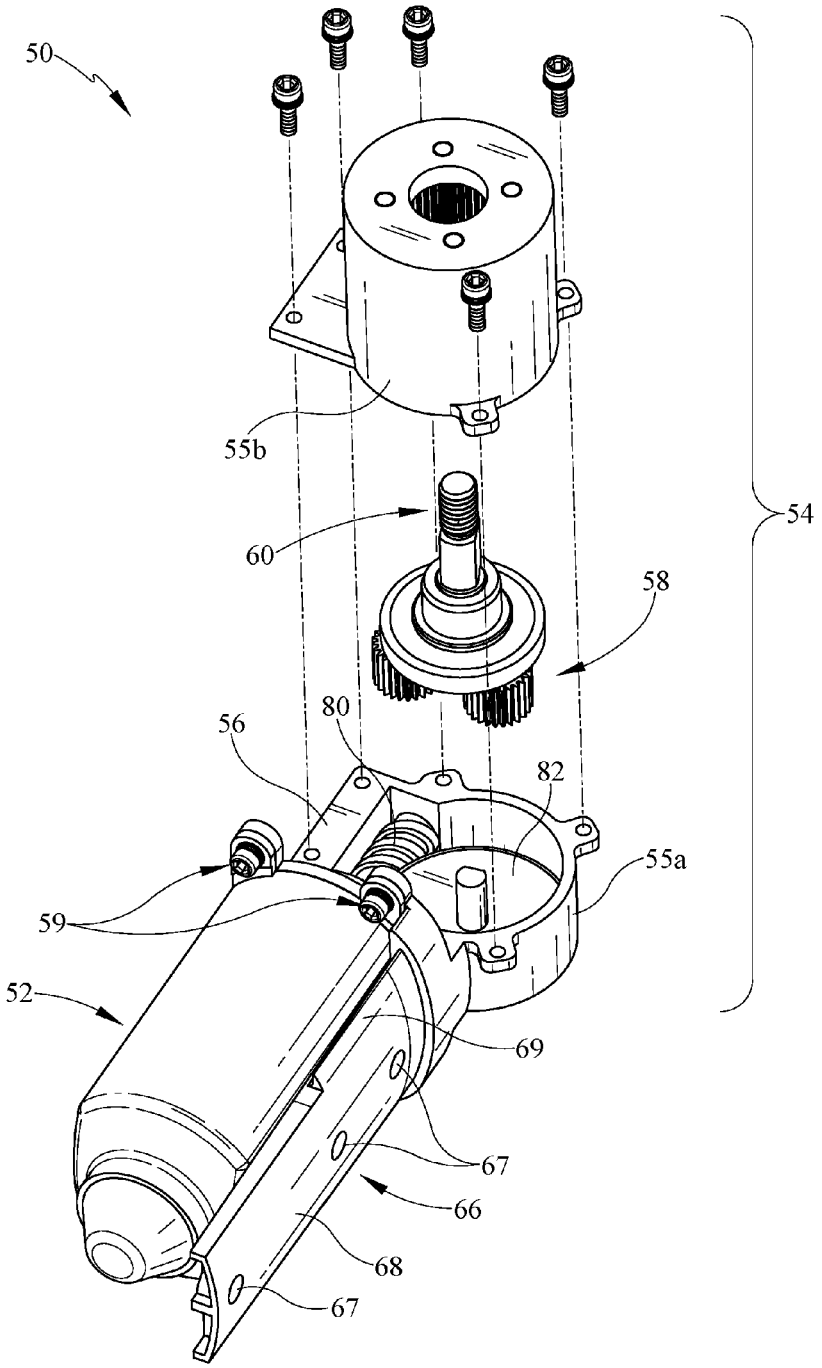
FIG. 4 is a front perspective view of one example of an angled gear motor.

Referring now to FIG. 4, a front perspective view of the angled gear motor 50 is depicted. Various characteristics may be considered in the selection of the gear motor 50. Some non-limiting characteristics which may be used to size the gear motor 50 include desired torque at a roller tube 40, rotational speed of the roller tube 40, and gear motor 50 size. The angled gear motor 50 comprises the motor 52 and a transmission 54. The transmission 54 comprises worm 80, a worm gear 82 and a gear box 55 having a plurality of gears 58 therein. The motor 52 may be a 12 volt DC motor which may have, for example, a 400 in-lbs stall torque and 300 in-lbs operational torque and may drive an RPM of 25 RPM at an output drive shaft 60 However, this is merely one embodiment and others may be utilized depending on size and weight characteristics of the awning assembly, as well as other design characteristics which may vary. The motor 52 has a drive shaft which may be connected to or integrally formed with a worm gear or other gear structure which operably engages the transmission 54. According to the instant embodiment, the motor 52 drives a worm 80 which extends from the motor 52 and is in a worm housing 56. The worm 80 drives a worm gear 82 which in turn drives gears 58 in the gear box 55. The worm 80 may be formed on a motor shaft or may be connected by, for example, placing a worm over the motor shaft, and may be fixed to the motor shaft for rotation with the motor 52. As the worm 80 and the worm gear 82 rotates, a plurality of gears 58 on the interior of the gear box 55 causing rotation of an output drive shaft 60. The output drive shaft 60 rotates causing rotation of roller tube 40 (FIG. 3). The above design characteristics may also be measured at the drive shaft 60 rather than the roller tube 40. In some embodiments, the shaft 60 may extend from the roller tube 40 into the gear box 55. The gear architecture, gear sizes and ratios may be sized and adjusted depending on the desired speed and torque at the shaft 60. Additionally, the transmission may include a joint to compensate for off axis operation of the roller tube wherein the roller tube is not aligned with the drive shaft of the transmission 54.

The motor 52 and the transmission 54 may be manufactured as a single structure or may be joined together as shown by fasteners 59. Either embodiment is considered within the scope of the present claims. Further the angled gear motor 50 may comprise an angled transmission which receives an input in one direction and provides an output in a second direction which is non-coaxial and/or non-parallel to the first direction. In this embodiment, the worm 80 receives input in a direction at least in part determined by the motor 52 and the gear box 55 provides an output at drive shaft 60 in a second direction, which according to some embodiments is generally a right angle, although such angle should not be considered limiting.

Also depicted, positioned along the motor 52, is a flange 66. The flange 66 is utilized to position the motor 52 within the hardware 24 (FIG. 3) and specifically, within the third arm 32 (FIG. 3) of the hardware 24. In this way, the angled gear motor 50 is supported by the hardware 24 and specifically the motor 52 is fully or at least partially disposed within the hardware 24 so that the axis of the motor 52 is coaxial with or longitudinally aligned with the longitudinal axis of the hardware 24 or arm 32 and may or may not be located within hardware 24 or arm 32. In other words, the motor 52 may be supported by the arm by being fully or partially within the arm 32 or may be supported by the arm but spaced from and aligned with the hardware 24 or arm 32, for example aligned with but spaced from the arm. The flange 66 may be formed as part of the motor or motor housing, or may be formed separately and attached to the motor 52 or to another part to which the motor is connected. The flange 66 may have one or more fastening apertures 67, which allow for connection of the flange to the hardware 24. The flange 66 may also have a curved outer surface 68 which approximates the curved surface of the third arm 32 so that the flange 66 can fit against the curved inner surface of the third arm 32 and minimize wasted space therein. Further, this allows load support for the motor 52 by the hardware 24. The flange 66 allows for support by the third arm 32 and bracing of the angled gear motor 50 both against the third arm 32 for added strength and rigidity. The flange 66 may have one or more flange tabs 69 which engage corresponding arm tabs 33 located within the third arm 32 to position the angled gear motor 50 for subsequent fastening through the third arm 32 and the flange 66.

Figure 5:
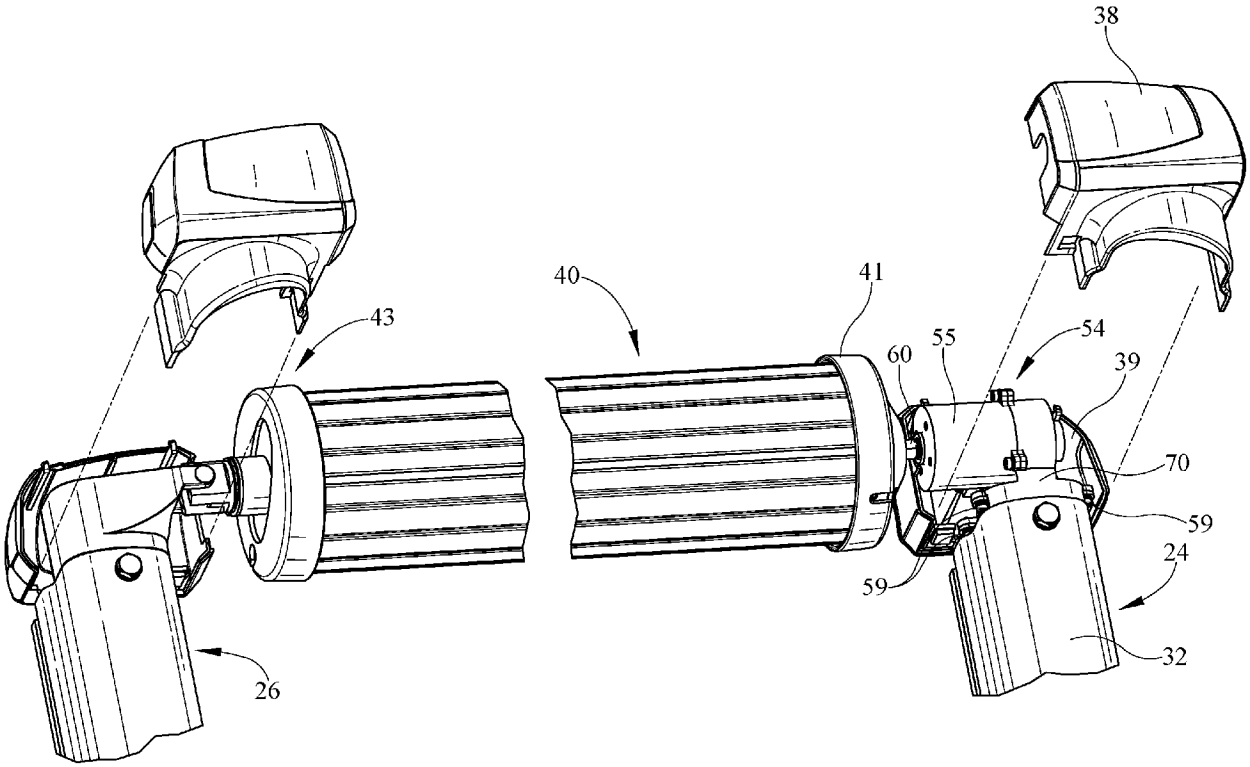
FIG. 5 is a perspective view of the awning assembly and angled gear motor in a partially exploded view.

Referring now to FIG. 5, a perspective view of the angled gear motor 50 and the hardware 24 is depicted with the cover 38 exploded to reveal the angled gear motor 50. As depicted, the angled gear motor 50 is disposed within the hardware 24, as shown. The motor 52 (FIG. 4) is disposed or positioned within the third arm 32 of the hardware 24. This may be fully disposed as shown wherein only the worm 80 or motor shaft extend from the arm 32 or alternatively that the motor 52 is at least partially positioned within the arm 32. Accordingly, the worm 80 (FIG. 6) which is on the back side of the structure depicted, extends upwardly from a mounting bracket 70 positioned at the end of the hardware 24. The transmission 54 is disposed on top of the mounting bracket 70. Further, the flange 66 may be formed with the bracket 70 or may be otherwise connected to the bracket 70 in some embodiments.

Further shown in this view, the output drive shaft 60 of the gear box 55 is shown extending through an end cap 41 of the roller tube 40. A joint, for non-limiting example a universal joint, may be employed to allow for variation of alignment and/or increased angular deflection between the roller tube 40 and the hardware 24. At an opposite end of roller tube 40 is a second end cap 43 which has a pivoting connection relative to the hardware 26. When the angled gear motor 50 is driven at one end of the roller tube 40, the opposite end cap 43 rotates with tube 40 and about connection with hardware 26. This may or may not utilize such joint as at between the roller tube 40 and the hardware 24.

Figure 6:
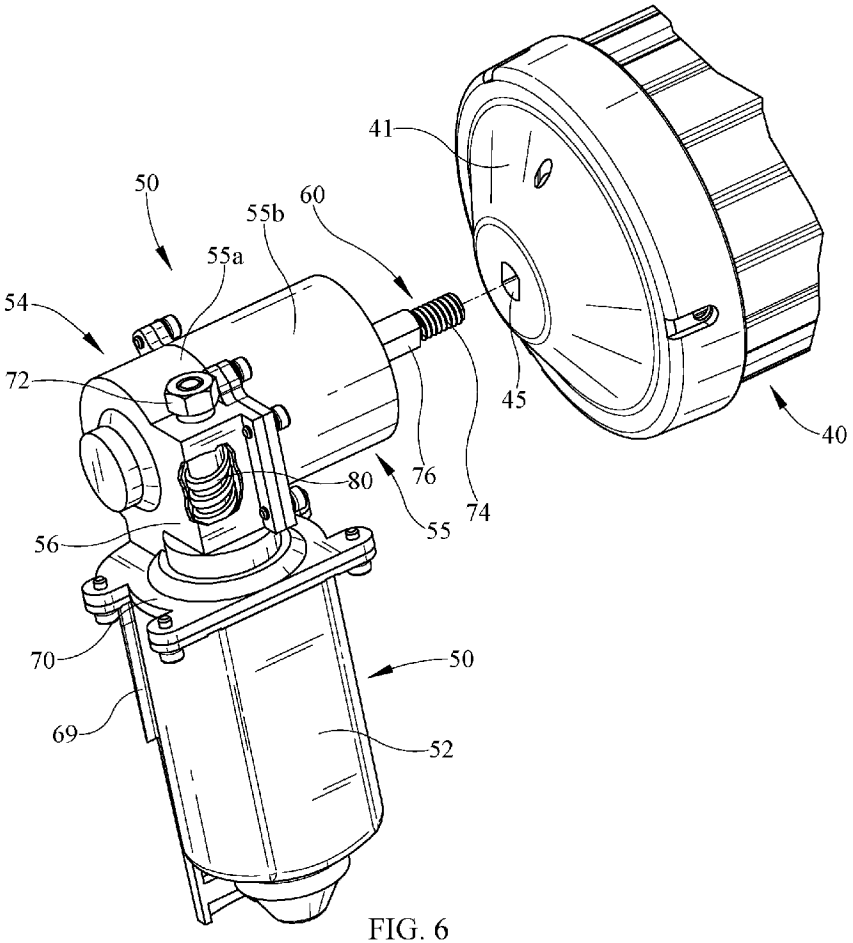
FIG. 6 is a rear perspective view of the awning hardware and angled gear motor with some features removed.

Referring now to FIG. 6, the angled gear motor 50 is shown adjacent to the roller tube 40. The third arm 32 (FIG. 5) of the hardware 24 (FIG. 5) receives the motor 52. The motor 52 extends downwardly into the third arm 32 of the hardware 24 until the mounting bracket 70 engages the end of the hardware 24. One of the flange tabs 69 is depicted in the embodiment. The flange tabs 69 may be used to retain and locate the gear motor 50 within the hardware 24 prior to the fastening of the angled gear motor 50 therein. This also provides a load support function. Above the mounting bracket 70 is the transmission 54 having the first, worm gear housing portion 55*a*, the second gear housing portion 55*b*, and the worm housing 56. The worm housing 56 and the worm gear housing portion 55*a* may be formed together as shown or may be formed separated and joined or connected together. Extending through the worm housing 56 is the worm 80 with a fastener or other torque applying structure 72 which functions as an override structure, for example if there is no power. The torque applying structure 72 may be a nut which is engaging the motor 52 or drive shaft 60 either directly or indirectly through the gear box 55 to cause rotation of the roller tube 40. The nut may be threadably attached to the worm 80 or the motor shaft or both and may be fixed relative thereto for example by a pinned or other connection. The torque applying structure 72 in some embodiments may extend from the worm 80 or may be connected thereto within or exterior from the worm housing 56. The torque applying structure 72 allows for application of torque to manually rotate the worm 80 and thereby manually rotate the gears 58 (FIG. 4) within the gear box 55 to extend or retract the roller tube 40. The term "manual" may apply to manual turning through the use of hand tools such as a socket or wrench or alternatively, may include the use of power hand tools for an automated movement. The automated power tools may include, for example, a drill or other rotary driver to which a socket may be connected for engagement of the torque applying structure 72. While the override structure is shown on the worm 80, the override functionality may also be applied to worm gear 82 and at the gear box 55.

The output drive shaft 60 is also shown extending from the gear box housing 55, specifically the second portion 55*b*. In other embodiments, the drive shaft may extend from the roller tube 40 and into the gear box housing 55. The end cap 41 is removed and the roller tube 40 is shown only to provide reference for positioning and structure. The output drive shaft 60 may have a threaded portion 74 and a key 76 so that the key 76 can provide torque input to the roller tube 40 and the threaded portion 74 may retain the angled gear motor 50 connected to the roller tube 40.

The drive shaft 60 may extend through the end cap 41. The end cap 41 may have a hole 45 which is shaped or keyed to correspond to the drive shaft key 76. The threaded portion 74 may extend to an inner side of the end cap 41 and be connected thereto by a nut or other fastener. In this embodiment, the torque of the drive shaft 60 is transferred to the end cap 41 which is connected to the roller tube 40. Thus, the drive shaft 60 may be directly connected to the end cap 41 or roller tube 40. In the alternative, the drive shaft 60 may also be indirectly a connected for a variety of reasons, including but not limited to, a joint, such as a universal joint to allow for misalignment between the drive shaft and the roller tube 40.

Figure 7:
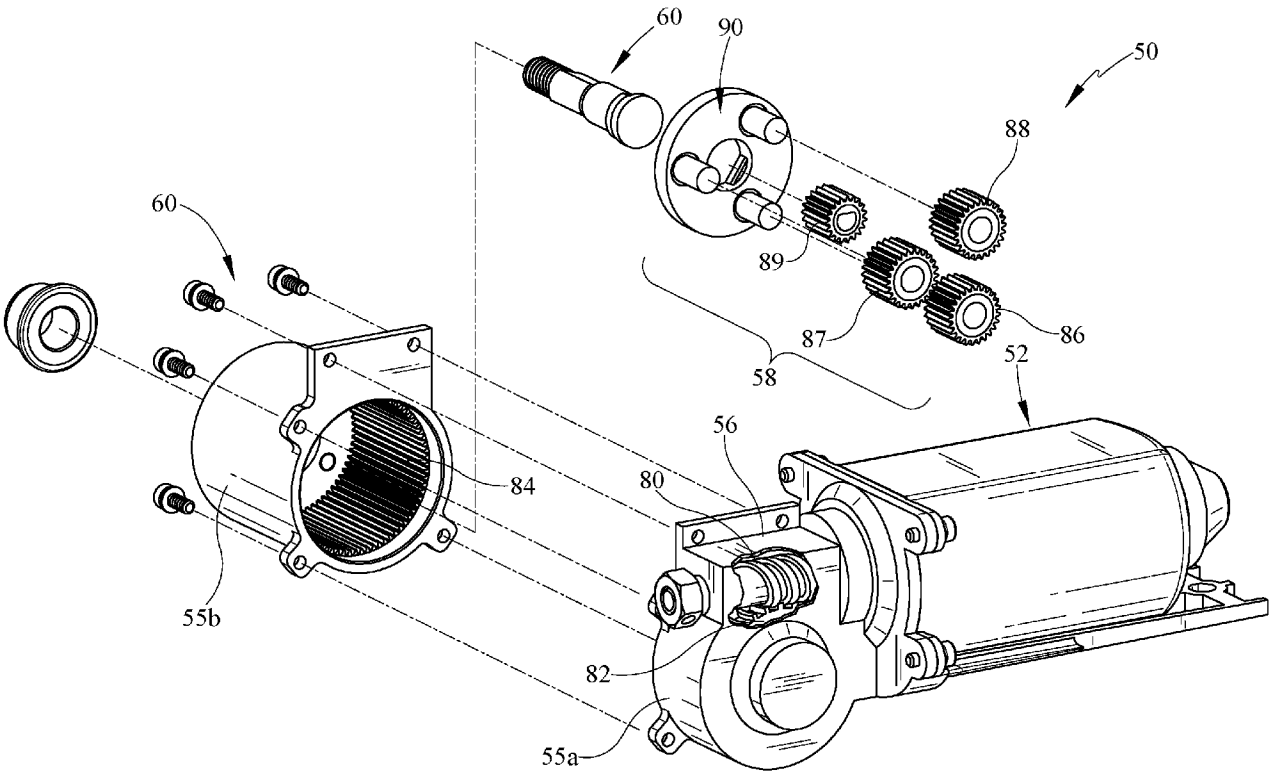
FIG. 7 is an upper perspective view of the angled gear motor and an exploded transmission.

Referring now to FIG. 7, a further exploded perspective view of the angled gear motor 50. The gear box 55, designated by housing portions 55*a*, 55*b* is also exploded so that the gear box housing second housing portion 55*b* is spaced apart and the fasteners removed. As shown herein, the gear box 55 is formed of the two or more housing portions 55*a*, 55*b* which are fastened together by a plurality of fasteners and contain the plurality of gears 58. The fasteners may comprise screws, bolts or alternatively may be clipped together using clips or other fastening structure such as rivets. Various types of connections may be utilized. However, in other embodiments, the gear box housing 55*a*, 55*b* may be formed of a single structure which fully encloses all of the gears and is formed of a single part.

The second gear housing portion 55*b* may include a plurality of gears 58, which is exploded from the gear box housing 55*b*. In the exemplary embodiment, the structure includes a sun gear is centrally located between three planetary pinion gears. The carriage 90 includes planetary gears 86, 87, 88 which rotate about a sun gear 89. The drive shaft 60 is connected to the carriage 90 and driven by the carriage 90. While one carriage 90 and one set of planetary gears 86, 87, 88 are shown, other embodiments may be provided wherein two or more carriages, sets of planetary gears and sun gears may be provided so that the torque or speed at the drive shaft 60 may be varied to meet one or more desirable characteristics. In operation, the plurality of gears 58, specifically sun gear 89, receive an input speed from the worm gear 82. This causes rotation and orbiting of the planetary gears 86, 87, 88 and rotation of the carriage 90. The plurality of gears including the carriage 90 reduce the speed from the worm gear 82 but increase torque at the drive shaft 60. The worm gear 82 drives rotation of the sun gear 89 which in turn rotates planetary gears 86, 87, 88 that thereby rotate carriage 90 which connects to drive shaft 60.

Figure 8:
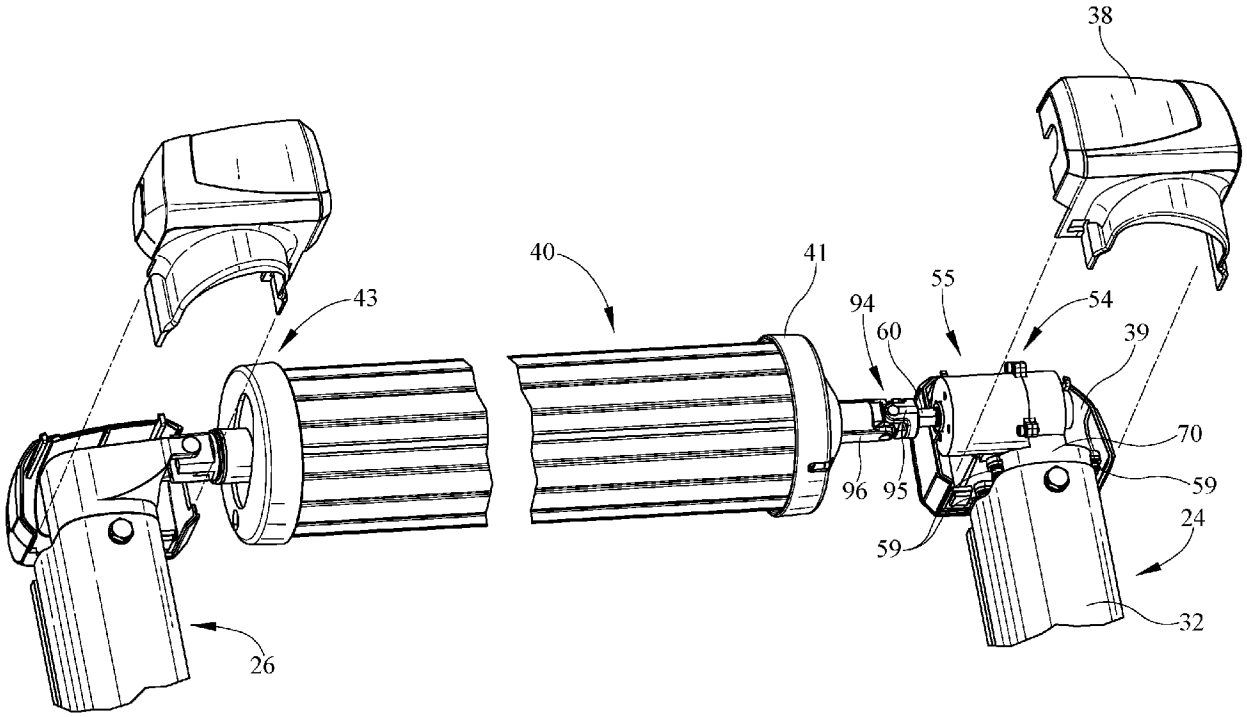
FIG. 8 is a perspective view of an alternate embodiment comprising a joint disposed between an awning roller tube and the angled gear motor; and, FIG. 9 is a perspective view of an alternate embodiment wherein the roller has a fixed position and the rotation of the roller tube occurs at the sidewall.

Referring now to FIG. 8, an alternative embodiment is provided wherein the drive shaft 60 is connected to a joint 94. The joint 94 according to some embodiments may be a universal joint which allows for some misalignment between the drive shaft and the roller tube 40 generally. During operation of the awning assembly, it is possible that that one end of the roller tube moves toward or away from the sidewall 12 (FIG. 1) faster than the other end. As a result, this may result in undesirable forces on the gears of the transmission 54 and may result in binding of the transmission or undue loading on the motor 52.

The instant joint 94 may be embodied, in some embodiments by a universal joint. The joint 94 has a first yoke 95 which is connected to a second yoke 96 by a journal cross, center block or other central connector. The connection allows pivoting of the joint 94 about two perpendicular axes. The second yoke 96 may be connected to the end cap 41 or the roller tube 40 directly or indirectly so that torque is transferred to drive rotation of the roller tube 40. In some embodiment, the end cap 41 may be formed with the second yoke 96 and so that the second yoke 96 extends therefrom. By extending from the end cap 41, the second yoke 96 may extend from an exterior surface or may extend from interior structure which defines a portion of the end cap 41 or is connected thereto.

Figure 9:
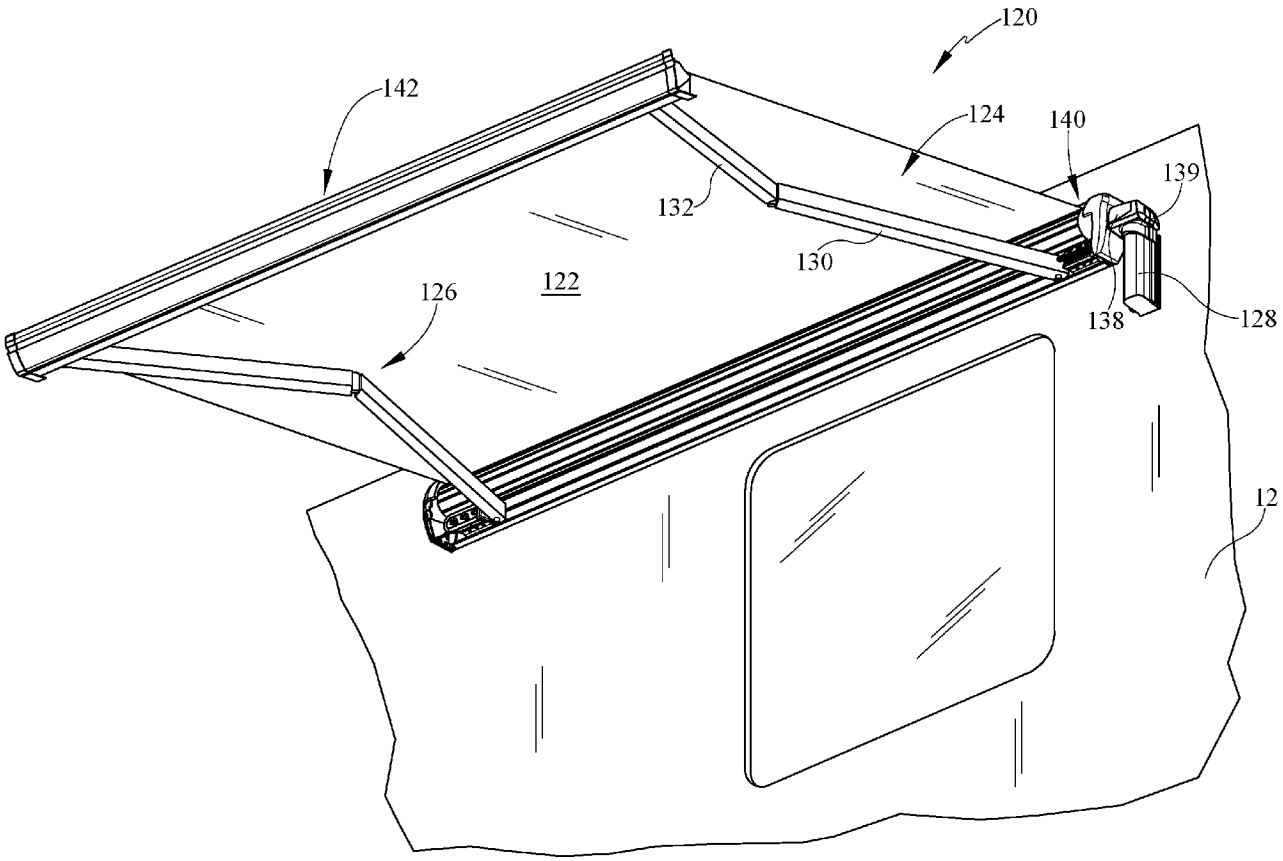

Referring now to FIG. 9, a further embodiment of an awning assembly 120 is provided. The embodiment depicts an alternate awning assembly 120 which may provide for the roller tube 140 to be in a fixed location relative to the sidewall 12 and rotate at that location to extend or retract an awning canopy 122. At the leading edge of the canopy 122 is an awning bar 142 which may be of various cross-sectional shapes. As can be seen, this cassette-type awning assembly does not move the roller tube 140 from one position to another.

The awning assembly 120 includes a first hardware 124 and second hardware 126. Each hardware or hardware assembly includes two arms 130, 132. The first arm 130 is pivotally connected to a base portion 133 of the assembly 120 and the second arm is pivotally connected to the first arm 130. The first and second arms 130, 132 move through a horizontal plane to extend or retract the awning canopy 122.

To one side of the awning assembly 120 is a gear motor which is not shown due to the covering parts. An arm 128 is shown positioned adjacent to the sidewall 12. The arm 128 receives the motor as described previously. The motor may be partially housed in the arm 128 or may be fully housed therein. At the upper end of the arm 128, the motor may be connected to the transmission which is also covered in this view by the covers 138, 139.

The transmission conveys torque from the motor to the roller tube 140 either directly or indirectly to rotate the roller tube and extend or retract the canopy 122.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An awning assembly, comprising:

a first awning hardware having a first plurality of arms;

a second awning hardware having a second plurality of arms;

a canopy configured to extend or retract from a roller tube, said canopy having a first lateral edge and a second lateral edge, an inner edge and an outer edge;

one of said arms being elongate and at least partially hollow, a motor disposed within said arm; and, an angled transmission operably connected to said motor, said angled transmission disposed at an end of said one of said arms, said motor and said angled transmission configured to rotatably extend or retract said canopy.

2. The awning assembly of claim 1, said angled transmission comprising a worm, a worm gear and a plurality of gears.

3. The awning assembly of claim 2, further comprising a worm housing wherein said worm is disposed and a gear housing wherein said worm gear is disposed.

4. The awning assembly of claim 3, said worm extending from said motor.

5. The awning assembly of claim 4, further comprising a drive shaft extending from said angled transmission.

6. The awning assembly of claim 5 wherein said roller tube is operably connected to said drive shaft.

7. The awning assembly of claim 6 wherein said roller tube further comprises an end cap engaging said drive shaft.

8. The awning assembly of claim 5 further comprising a joint connected to said drive shaft.

9. The awning assembly of claim 1 further comprising an arm tab disposed at an end of said one of said arms.

10. The awning assembly of claim 9, further comprising a flange tab engaging said arm tab.

11. The awning assembly of claim 1 further comprising a cover extending over said angled transmission at said end of said one of said arms.

12. The awning assembly of claim 1 said motor and said angled transmission being one of connected or being integrally manufactured.

13. The awning assembly of claim 1 wherein said roller tube configured to rotate adjacent to a sidewall.

14. The awning assembly of claim 1 wherein said roller tube is configured to move toward and away from a sidewall.

15. An awning assembly, comprising:

a canopy having a first lateral edge, a second lateral edge, an inner edge and an outer edge;

a first hardware and a second hardware, each comprising at least one arm which may be configured to extend and retract with said canopy;

one of said arms being elongate and at least partially hollow, a motor disposed at least partially within said arm and supported by said arm; and, an angled gear transmission disposed at an end of said at least one of said arms, said angled gear transmission being driven by said motor and extending and retracting said canopy.

16. The awning assembly of claim 15, said angled gear transmission comprising a worm, a worm gear and a gear box.

17. The awning assembly of claim 16, further comprising a manual override on one of said worm, said worm gear and said gear box.

18. The awning assembly of claim 15, said angled gear transmission disposed at an end of one of said hardware.

19. The awning assembly of claim 16, said angled gear transmission comprising a drive shaft extending from said gear box.

20. The awning assembly of claim 15 wherein only one of said worm gear or a motor shaft extends from said at least one of said arms.

21. The awning assembly of claim 15 further comprising a cover disposed over said angled gear transmission, said cover located at an end of said at least one arm.

22. The awning assembly of claim 15 wherein said motor and said angled gear transmission may be formed together or may be formed separately and joined during manufacture.

23. The awning assembly of claim 15 wherein said awning assembly is a cassette awning.

24. The awning assembly of claim 15 wherein said awning assembly is a moveable roller tube awning.

25. An awning assembly, comprising:

a first awning hardware having a first plurality of arms;

a second awning hardware having a second plurality of arms;

a canopy having an inner edge and an outer edge extending between said first hardware and said second hardware and a first lateral edge and a second lateral edge;

one of said arms being elongate and at least partially hollow, a motor supported by said arm and connected to said arm by a motor flange, said motor being one of partially in said arm or fully in said arm; and, an angled transmission operably connected to said motor, said angled transmission disposed at an end of said one of said arms, said motor and said angled transmission configured to rotatably extend or retract said canopy.

26. The awning assembly of claim 25 further comprising a roller tube operably connected to said motor and said angled transmission.

27. The awning assembly of claim 26, said roller tube configured to move with said first and second hardware during extension or retraction of said canopy.

28. The awning assembly of claim 26 wherein said roller tube is operated at a sidewall.

29. The awning assembly of claim 25 wherein said motor flange and said one of said arms includes tabs for locating said motor.

30. The awning assembly of claim 26 further comprising a joint between said transmission and said roller tube.

* * * * *